US005433690A

United States Patent [19]

Gilman

[11] Patent Number: 5,433,690

[45] Date of Patent: Jul. 18, 1995

[54] SIDE JUMP AND BODY TWIST EXERCISING APPARATUS

[76] Inventor: Stewart B. N. Gilman, 10365 Holman Ave., Los Angeles, Calif. 90024

[21] Appl. No.: 85,354

[22] Filed: Jun. 11, 1993

[51] Int. Cl.[6] ..... A63B 21/015

[52] U.S. Cl. ..... 482/146; 482/147; 482/71

[58] Field of Search ..... 482/146, 147, 53, 54, 482/70, 71, 148

[56] References Cited

U.S. PATENT DOCUMENTS

| | | | |
|---|---|---|---|
| 1,535,391 | 4/1925 | Anderson | 482/117 |
| 1,707,791 | 4/1929 | Anderson | 482/114 |
| 3,021,137 | 2/1962 | Palmer et al. | 482/71 |
| 3,640,527 | 2/1972 | Proctor | 482/142 |
| 3,784,193 | 1/1974 | Simjian | 482/146 |
| 3,802,701 | 4/1974 | Good, Jr. | 482/119 |
| 4,390,180 | 6/1983 | Simjian | 482/146 |
| 4,515,363 | 5/1985 | Schleffendorf | 482/146 |
| 4,799,668 | 1/1989 | Jansen | 482/57 |
| 5,002,272 | 3/1991 | Hofmeister | 482/71 |
| 5,040,785 | 8/1991 | Charnitski | 128/25 R |

*Primary Examiner*—Richard J. Apley
*Assistant Examiner*—Jerome Donnelly

[57] ABSTRACT

An exercise apparatus wherein a supporting base carries a rotatable platform oscillated by a drive from a hand held support that stabilizes the person exercising, characterized by an upstanding fence on the platform and over which the person jumps from side to side, the degree of rotation being variably controlled by the person.

17 Claims, 2 Drawing Sheets

SIDE JUMP AND BODY TWIST EXERCISING APPARATUS

BACKGROUND OF THE INVENTION

This invention relates to cardiovascular fitness stimulated by enforcing body exercise, it being a general object of this invention to stimulate an interest in variations of natural body motions that are coordinated with physical force applied by the body. However, repetition of the same exercise is by its very nature monotonous and boring. Therefore, it is an object of this invention to provide variations in the exercise and thereby create a stimulus for its continued application.

It is an object to exercise the entire body, induced into motion by jumping from side to side over a barrier while stabilized by a hand held support. It is also an object to shift the barrier from side to side in response to a turning force applied at said support, whereby force is exerted through both the pelvic girdle and pectoral girdle of the person's body. As to the application of force and/or exertion, it is an object to enable many variations, as will be described, in force application under control of the person exercising. That is, the elected jumping direction involves the pelvic girdle and related turning or twisting of the pectoral girdle, and all of which is infinitely variable within limits. Accordingly, it is an object to apply forces by twisting the torso of the body with turning force applied through the body support, while varying the side to side direction or positioning of the barrier to be jumped.

The aforementioned exercising requirements involve simultaneous jumping and torso twisting and body support turning, it being an object of this invention to provide a shiftable barrier to be jumped, an oscillating body support to be manipulated, and drive means for shifting the barrier in response to oscillating the body support. In practice, the barrier is adjustable as to height and is carried by a rotatable platform, the body support being a pair of spaced hand grips, and the drive means being a motion transfer means that rotates the platform and barrier in response to rotation of the body support.

It is an object of this invention to controllably augment the degree of exercise motion applied by and to the person's body. To this end the rotation of the platform and barrier is inverse to that of the body support and hand grips, whereby shifting of the barrier to one side is in response to twisting the torso of the body to the opposite side. It is to be understood that the person exercising has control over the degree thereof.

The exercising apparatus is embodied in a machine as shown, and there is a stop to limit the degree of barrier shift, and there is a means to brake the otherwise free turning body support and shifting barrier. The position of the stops and amount of body twist is determined by limit means as circumstances require.

SUMMARY OF THE INVENTION

In accordance with this invention, shifting of the barrier is essentially side to side when observing motion thereof at its foremost portion This barrier motion can be rectilinear but is preferably by rotation about a vertical axis spaced rearward of said foremost portion of the barrier. In practice, this axis of rotation is midway between the foremost and rearmost portions of the barrier, in which case the barrier oscillates about a central axis, and this enforces a twisting effect upon the pelvic girdle and entire torso of the person exercising. A feature of this invention is that the person exercising has control over the degree of twisting applied through turning of the body support at the hand grips. The drive means positively positions the platform and barrier in response to turning of the body support. And, the body support steadies the person exercising and thereby gives him confidence by reducing the danger of tripping over the barrier. However, a feature of this invention is flexibility of the barrier so that it will collapse if stepped upon.

This exercising apparatus is characterized by an oscillating platform having a fore and aft upstanding barrier and forward of which there is a substantially waist high body support with hand grips for manipulation. The body support is manipulated to turn by oscillating movement that enforces a commensurate oscillation on the platform and barrier. The drive means is direct, to inversely rotate the platform and barrier to the degree controlled by the person exercising.

The foregoing and various other objects and features of this invention will be apparent and fully understood from the following detailed description of the typical preferred form and application thereof, throughout which description reference is made to the accompanying drawings.

THE DRAWINGS

Figure 1:
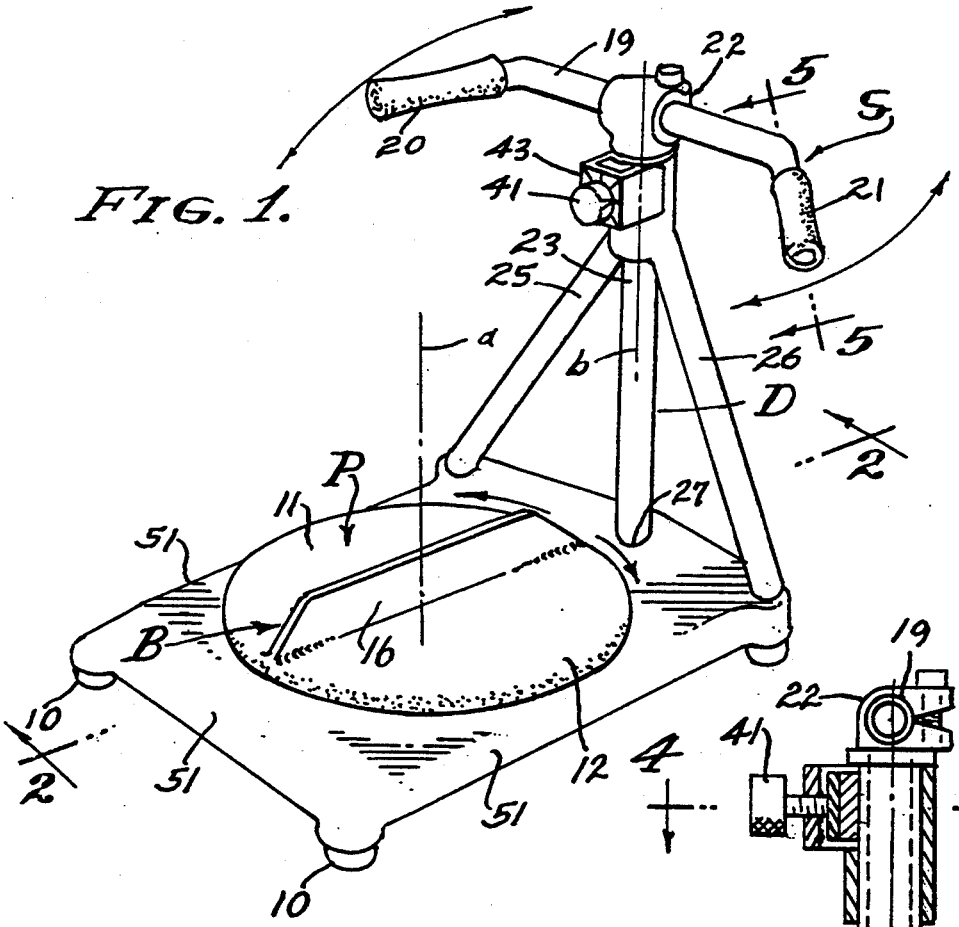
FIG. 1 is a perspective view of the side jump and body twist exercising apparatus of the present invention, disposed in a normal passive condition.
Figure 5:
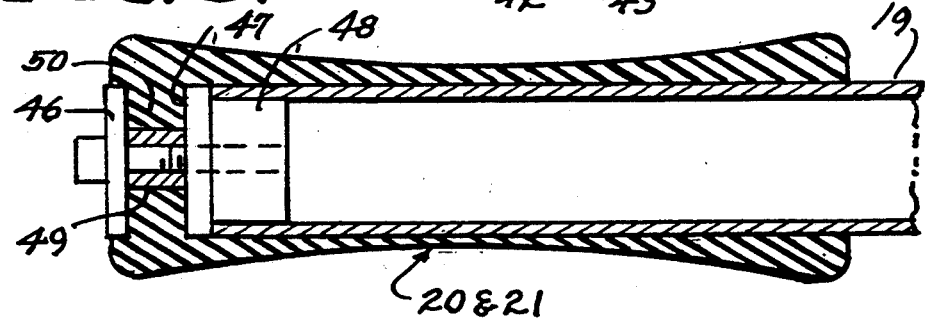

And, FIG. 5 is an enlarged detailed sectional view taken as indicated by line 5—5 on FIG. 1.

PREFERRED EMBODIMENT

Referring now to the drawings, there is a base A that supports a rotatable platform P. The platform is horizontally disposed and turns upon a vertical axis a. The base A is preferably a flat horizontal support of rectangular configuration having four corner legs 10 for floor support. The platform P occupies a substantial portion of the base A and presents a space upon which a person stands, and large enough to stand at one side 11 or 12 as defined by a barrier B that extends fore and aft of this exercising apparatus and projects upwardly in the form of a fence that is to be jumped by the person exercising. That is, the person is to jump from side 11 to side 12 and vice versa.

In accordance with this invention, the platform P is movable from side to side, and preferably rotatable so as to oscillate on the vertical axis a. In other words, the platform P turns from side to side. Turning movement is enabled by bearing means disposed between the base A and the platform P, whereby the platform is free to rotate on the base while the top plane, sides 11 and 12, remains horizontal. As shown, there are opposed peripheral bearing races 13 and 14 formed in the top and bottom sides of the base and platform, and between which anti-friction ball bearings 15 roll (see FIGS. 2 and 3). The base A has an opening within the bearing race 13, said opening being covered by the overlying platform P. The platform is captured to the base A by a plurality of circumferentially spaced clips C, shown herein as secured to the platform with fingers closely underlying the base.

Figure 2:
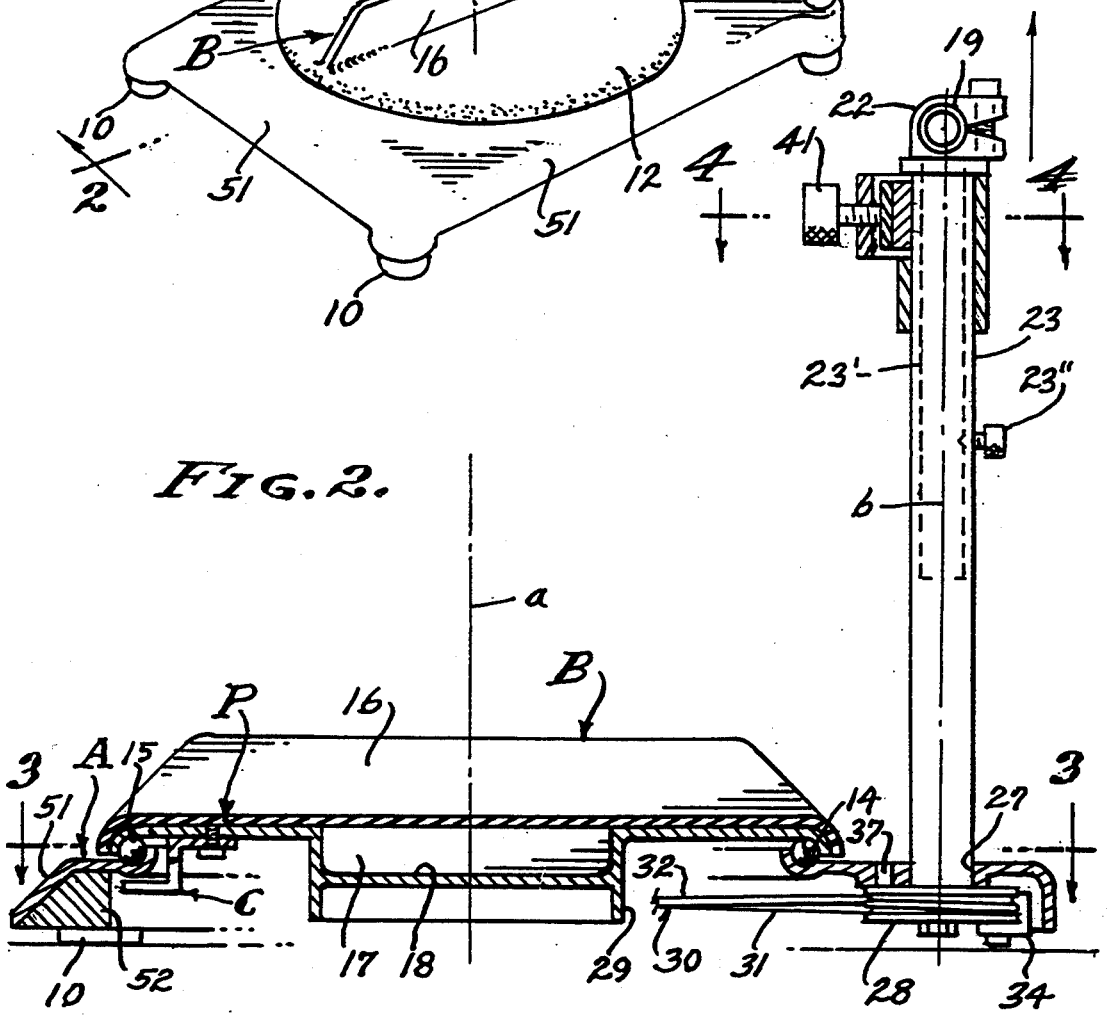
FIG. 2 is a vertical sectional view taken as indicated by line 2—2 on FIG. 1.

The barrier B can be adjustable as to height and is shown as a simple replaceable fence 16 integrally incorporated in a flexible soft pad (elastomer) that coextensively covers the platform P and that can be stepped upon without injury to the person exercising. In practice, the fence-pad presents a cushioned non-skid surface and has a downwardly projecting anchor section 17 received in a socket 18 of the platform P, the fence-pad being removable so as to make adjustment by replacement with fences 16 of different height. In practice, the fence 16 of barrier B extends to a height of as much as twelve inches and is normally disposed diametrically of the platform P and is oscillated together with the platform as will be described.

the body support 5 is provided to stabilize the person exercising and is in the form of a rigid standard to be grasped by the person when standing upon either or both sides 11 and 12 of the platform P. In practice, the body support S presents a handlebar 19 with right and left hand grips 20 and 21 for manipulation by the person exercising. The handlebar 19 is vertically adjustable in a stem 23 by means of a telescoping member 23' positioned by a set screw 23''. The grips are positioned approximately waist high and the rearwardly disposed grips are angularly adjusted by means of a clamp 22 and screw tightener as shown in FIGS. 1 and 2. The handlebar 19 is a straight normally transverse member with rearwardly turned grips 20 and 21.

In accordance with this invention, there is a motion transfer drive means D form the body support S to the platform P. More particularly, the handlebar 19 that is grasped by the grips 20 and 21 for stability is manipulated to controllably move the platform P and barrier 3. Accordingly, the handlebar 19 is rigidly coupled to member 23'' disposed on a vertical axis b, forward of and parallel to the axis a, and is journaled in a header 24 supported by divergent legs 25 and 26 carried by the base A. Thus, the header 24 is rigid with the base A and the handlebar 19 and stem 23 turn free. The stem 23 has a collar that thrusts downwardly onto the header 24 and the stem 23 passes through a bearing 27 in the base A and carries a drive wheel 28 beneath the base and in horizontal alignment with a drum 29 concentric and integral with the rotating platform P.

Figure 3:
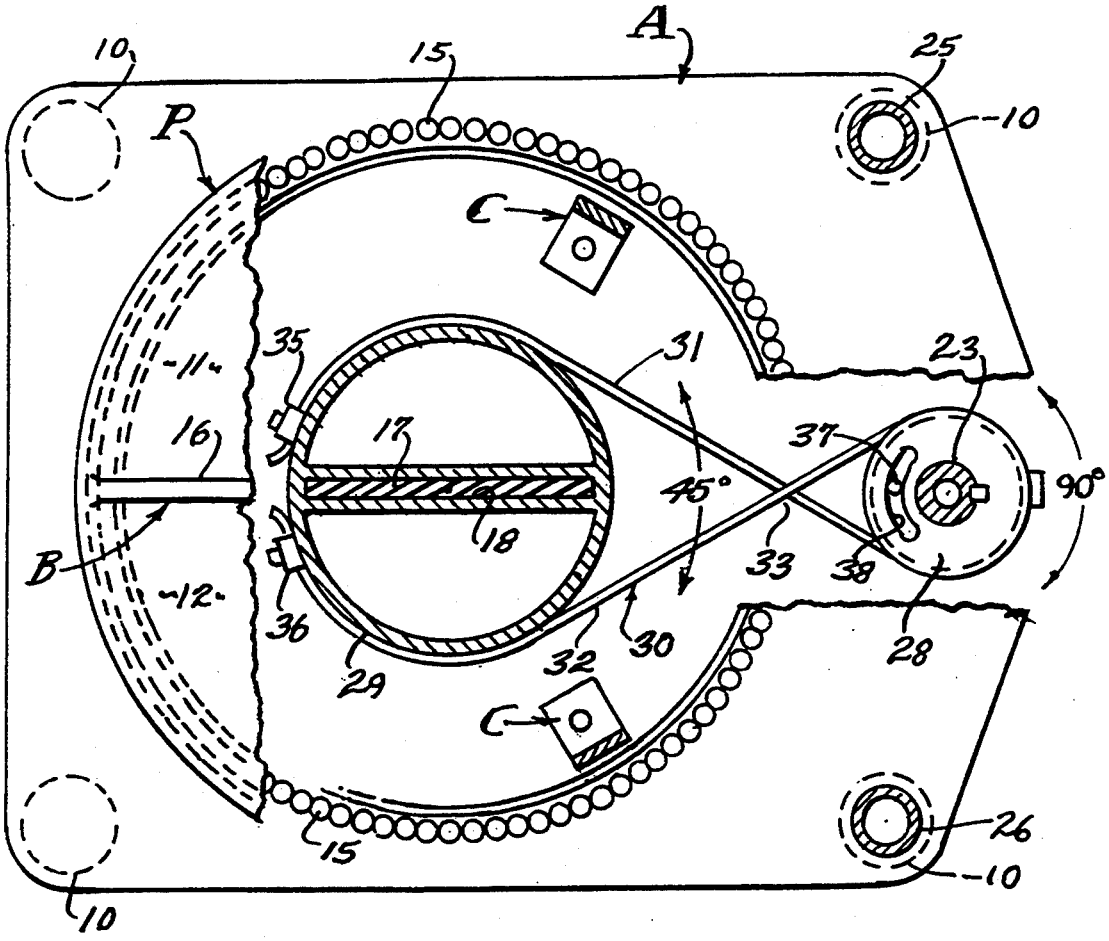
FIG. 3 is a plan section taken substantially as indicated by line 3—3 on FIG. 2, with portions of the base and platform broken away.

The drive means D can vary in form in order to move the platform P in response to manipulated turning of the handlebar 19 and stem 23. For example, the means D can be a drive link operating between two levers, or it can be a pair of intermeshed gears. Preferably, the drive means D is a wheel and drum drive wherein a cable 30 or the like is trained over the aforesaid drive wheel 28 in order to turn the aforesaid drum 29. Referring to FIGS. 2 and 3, it will be observed that a cable 30 is wrapped around the drive wheel 28 at least one turn with opposite ends 31 and 32 crossed at 33. Accordingly, the end 31 emanates clockwise from the drive wheel 28 and wraps counterclockwise onto the driven drum 29, whereas the end 32 emanates counterclockwise from the drive wheel 28 and wraps clockwise onto the driven drum 29. A suitable cable clamp 34 secures the center of cable 30 to the drive wheel 28, while suitable cable clamps 35 and 36 secure the ends 31 and 32 tightly to the driven drum 29.

Motion limit means E restricts the amount of movement permitted, shown herein as rotary oscillation limited to 90° turning of the handlebar 19 reduced to 45° turning of the platform P and barrier B. In practice, a stop pin 37 depends from the base A (see FIG. 2) and into a concentric slot 38 in the drive wheel 28. The slot 38 extends 45° to each side of a normal centered position with the handlebar disposed transversely. As shown, the driven drum 29 is twice the diameter of the drive wheel 28, in which case the platform P and barrier B are limited to 22⅝° rotation to each side.

Figure 4:
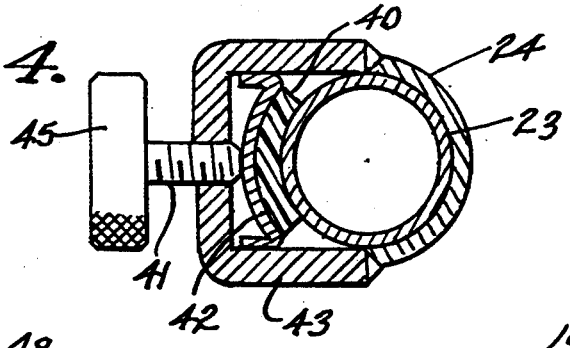
FIG. 4 is an enlarged detailed sectional view taken as indicated by line 4—4 on FIG. 2.

Referring now to FIGS. 1 and 4 of the drawings, motion damping means F is provided to impede free movement of handlebar 19 and resulting oscillation of the platform and barrier. The means F can vary in form and placement, as it can be applied directly to the platform P, or the to drive wheel 28, or preferably to the stem 23 as shown. A block of friction material 40 is shown pressed against the cylindrical surface of the stem, as by means of a knurled adjustment screw 41 operating against a protective backing plate 42. There is an upwardly open notch at one side of the header 24 into which the friction block 40 is inserted and captured by a surrounding cage 43 through which the screw 41 is threadedly engaged to press against the friction block 40. The front face 44 of the cage 43 is calibrated with incrementally spaced dial marks to which a pointer on knob 45 is adjusted to a determinable damping condition.

Referring back to the grips 20 and 21, and to FIG. 5 of the drawings, these grips are restrictively rotatable on the handlebar 19. As shown, the inner cylinder wall of the hand grip is free to turn on the exterior cylinder wall of the handlebar, and is retained in its rotatable position by a clutch disc 46 spaced from a pressure plate 47 at the end of the handlebar. The pressure plate 47 is the face of plug 48 inserted into the tubular handlebar. The said spacing of disc 46 and plug face is by means of a sleeve 49 dimensioned to compressably retain an end wall 50 of the grip 20 and/or 21. The grips 20 and 21 are made of compressible elastomer or the like with the end wall frictionally engaged to resist free turning. A feature is the increased frictional reisistance to turning by means of the person's grip that constricts the interior of the grip onto the exterior of the handlebar, an exercise feature that enforces gripping the handlebar grips for stability.

Referring to FIGS. 1 and 2 of the drawings, the perimeter of the base A is chamfered at 51 to avoid a sharp curb. Also, there is a ballast member 52 that adds mess to the base A as may be required.

From the foregoing it is apparent that the movement of the platform P is inverse to turning of the body support S. The movement of the platform is preferably controlled oscillation about the vertical axis a, to alternately position the barrier B clockwise and counterclockwise. Rotative positioning of the platform P and barrier B is controlled by the person exercising, as well as the timing thereof. When the handlebar 19 of the body support S is displaced counterclockwise the platform P and barrier B are displaced clockwise, and vice versa. A feature is that the angular displacement of the platform and barrier is reduced from that of the handlebar, and the degree of displacement is selective as may be desired. The barrier can be positioned fore and aft as shown in the drawings, or it can be angularly revolved and positioned clockwise or counterclockwise within the limits of means E. Clockwise positioning of the barrier B is the result of counterclockwise turning of the person's pectoral girdle or equivalent arm movement and which enforces twisting of the person's torso, assuming that the person's footing is substantially parallel to said barrier. Counterclockwise positioning of the barrier B results in a reverse of the foregoing. Angular displacement of the barrier B results in placing one platform portion 11 or 12 ahead of the other, and the person exercising has the option of jumping diagonally forward or backward. Since the angular displacement of barrier B is acute (22½° or less) the jumping exercise is essentially from side to side, and the presence of the barrier influences the person's footing to be substantially parallel therewith. The exercise enforced by this apparatus results in natural body movements that are used to control the extent of body movements applied.

Having described only the typical preferred form and application of my invention, I do not wish to be limited or restricted to the specific details herein set forth, but wish to reserve to myself any modifications or variations that may appear to those skilled in the art, as set forth within the limits of the following claims.

I claim:

1. A jump and twist exercising apparatus for controlled enforcement of natural body movements, and including;

a supporting base with a first vertically disposed turning axis and a forward extension with a second vertically disposed turning axis spaced from and parallel to said first axis, a platform rotatably carried by bearing means on the first mentioned turning axis and having opposite side portions with standing room defined by a barrier member of vertical height therebetween and extending diametrically through the turning axis, a body support comprised of a handlebar with a stem rotatably carried by bearing means on the second mentioned turning axis and having opposite side hand grips at a height to be grasped for body support and control, and drive means for inversely turning the platform and barrier with respect to manipulative turning of the handlebar by a person jumping the barrier from one side portion of the platform to the other.

2. The jump and twist exercising apparatus as set forth in claim 1, wherein the bearing means rotatably carrying the platform on the first mentioned turning axis is an anti friction means comprised of ball bearings operating in opposed races in the base and at the periphery of the platform.

3. The jump and twist exercising apparatus as set forth in claim 1, wherein the barrier has a normal passive position extending fore and aft in alignment from the first mentioned to the second mentioned turning axes.

4. The jump and twist exercising apparatus as set forth in claim 1, wherein the barrier member height is determined by replacement with a barrier member of selected height.

5. The jump and twist exercising apparatus as set forth in claim 4, wherein said barrier member replacement is by means of an upwardly opening socket in the platform receiving an anchor depending from a barrier member of selected height.

6. The jump and twist exercising apparatus as set forth in claim 1, wherein the barrier member is a planar fence of flexible material adapted to be stepped upon without injury.

7. The jump and twist exercising apparatus as set forth in claim 1, wherein motion limit means restricts turning movement of the drive means for turning the platform and barrier member in response to turning of the handlebar.

8. The jump and twist exercising apparatus as set forth in claim 1, wherein motion damping means impedes free movement of the drive means and turning of the platform and barrier member.

9. The jump and twist exercising apparatus as set forth in claim 1, wherein the body support includes a rigid standard projecting vertically from the forward extension of the base and having a header carrying said bearing means on the second mentioned turning axis for rotation of the handlebar stem.

10. The jump and twist exercising apparatus as set forth in claim 9, wherein motion damping means comprised of a brake block and adjustment means therefor carried by the header and bearing against the stem impedes free movement of the drive means and turning of the platform and barrier member.

11. The jump and twist exercising apparatus as set forth in claim 1, wherein the drive means includes a drive member on the stem and a driven member on the platform and with a drive means extending between said drive member and drive member.

12. The jump and twist exercising apparatus as set forth in claim 1, wherein the drive means includes a drive wheel on the stem in horizontal alignment with a drum on the platform and with a flexible member drivable with and extending between said wheel and drum for the transfer of motion therebetween.

13. The jump and twist exercising apparatus as set forth in claim 1, wherein the drive means includes a drive wheel on the stem in horizontal alignment with a drum on the platform and a flexible cable anchored to and wrapped around the wheel and having opposite ends anchored to and wrapped onto the drum for transfer of turning motion therebetween.

14. The jump and twist exercising apparatus as set forth in claim 1, wherein the drive means includes a drive wheel on the stem in horizontal alignment with a drum on the platform and with a flexible member drivable with and crossed between said wheel and drum for the inverse transfer of motion therebetween.

15. The jump and twist exercising apparatus as set forth in claim 1, wherein the drive means includes a drive wheel on the stem in horizontal alignment with a drum on the platform and a flexible cable anchored to and wrapped around the wheel and having opposite ends crossed between the wheel and drum and anchored to and wrapped onto the drum for inverse transfer of turning motion therebetween.

16. The jump and twist exercising apparatus as set forth in claim 1, wherein the body support is adjustable as to height by means of a vertically positioned member telescopically engaged with the stem and carrying the handlebar.

17. The jump and twist exercising apparatus as set forth in claim 1, wherein each hand grip of the body support is engaged to turn on the handlebar and is of compressible material for constriction onto the handlebar to frictionally restrict turning of said hand grip.

* * * * *